US005746070A

United States Patent [19]

Bailey et al.

[11] Patent Number: 5,746,070

[45] Date of Patent: May 5, 1998

[54] PLASTIC AND STAINLESS STEEL HORIZONTAL AXIS SPIN TUB

[75] Inventors: Jack W. Bailey, West Fargo, N. Dak.; Joseph E. Howard, Webster City, Iowa

[73] Assignee: White Consolidated Industries, Inc., Cleveland, Ohio

[21] Appl. No.: 649,570

[22] Filed: Jun. 7, 1996

[51] Int. Cl.[6] ..... D06F 37/06; D06F 37/22

[52] U.S. Cl. ..... 68/24; 34/322; 34/596; 34/599; 34/602; 68/142

[58] Field of Search ..... 68/23.2, 24, 142; 34/322, 596, 599, 602; 134/120; 451/328

[56] References Cited

U.S. PATENT DOCUMENTS

| | | | |
|---|---|---|---|
| 1,472,434 | 10/1923 | Oberg | 68/142 |
| 2,855,698 | 10/1958 | Hutt | 34/602 X |
| 4,423,607 | 1/1984 | Munini | 68/23.2 |
| 5,267,456 | 12/1993 | Nukaga et al. | 68/12.24 |

FOREIGN PATENT DOCUMENTS

| | | | |
|---|---|---|---|
| 217419 | 3/1961 | Austria | 68/142 |
| 1273418 | 9/1961 | France | 68/142 |
| 516368 | 2/1955 | Italy | 68/142 |
| 624690 | 9/1961 | Italy | 68/142 |

*Primary Examiner*—Philip R. Coe
*Attorney, Agent, or Firm*—Pearne, Gordon, McCoy & Granger LLP

[57] ABSTRACT

A spin drum for use in a horizontal axis clothes washing machine. The spin drum includes a generally semi-cylindrical side wall composed of stainless steel, first and second plastic end caps and first and second metal trunnions. The side wall has first and second ends with radially corrugated peripheries and a plurality of vanes that extend between the first and second ends. The vanes help define the radially corrugated peripheries of the first and second ends. The first and second plastic end caps are respectively secured to the first and second ends of the side wall and have flanges that are contoured to fit inside the radially corrugated peripheries of the first and second ends. The first and second metal trunnions are respectively disposed over the first and second plastic end caps and are secured to the first and second ends of the side wall and to the first and second plastic end caps.

21 Claims, 4 Drawing Sheets

PLASTIC AND STAINLESS STEEL HORIZONTAL AXIS SPIN TUB

BACKGROUND OF THE INVENTION

1. Field of the Invention

This invention relates to washers in general and, more particularly, to clothes washing machines having a spin drum with a horizontal axis of rotation.

2. Description of the Related Art

Typically, washers, such as clothes washers, have a housing containing an outer drum and an inner or spin drum. The outer drum is secured to the housing and holds wash fluid that is used during the various operating cycles of the washer. The spin drum holds wash items, such as clothing, during the operating cycles of the washer. The spin drum is rotatably mounted within the outer drum. Spin drums can either have a vertical or a horizontal axis of rotation. A spin drum having a horizontal axis of rotation is rotatably supported by a rotation shaft that projects through the outer drum. Exterior of the outer drum, the rotation shaft is connected to a motor by a power transmission system comprised of gears, pulleys and belts. The rotation of the motor is transmitted to the rotation shaft through the power transmission system, causing the rotation shaft and, thus, the spin drum to rotate about a horizontal axis.

Spin drums having a horizontal axis of rotation can either have a front opening or a top opening. A spin drum with a top opening is typically comprised of a wrapper, a door and a pair of end caps. The wrapper is cylindrically shaped and has an access opening in its side wall. The wrapper also has a plurality of perforations to permit wash fluid to enter and exit the spin drum during the operating cycles of the washer. The door is movable between closed and open positions wherein the door respectively covers and uncovers the access opening. The end caps are circular and have inward projecting flanges that respectively fit over the ends of the wrapper. In addition, the end caps have mounting shafts projecting outward therefrom. The end caps are secured to the ends of the wrapper by screws or by spot welding. The mounting shafts of the end caps are rotatably supported by the outer drum.

Since the end caps are subjected to a large amount of torsional stress, the end caps are composed of stainless steel because it is strong, lightweight and resistant to corrosion. For the same reasons, the wrapper is also composed of stainless steel. This extensive use of stainless steel increases the manufacturing cost of the spin drum because stainless steel is expensive.

Since the wrapper is elongated and is subject to torsional stress, the wrapper is usually strengthened with vanes or ribs. The vanes also help to tumble clothes in the spin drum. The vanes are evenly disposed around the inner circumference of the wrapper and extend laterally along the length of the wrapper. Typically, the vanes are composed of plastic and are secured to the wrapper with screws or snaps. This is undesirable because the installation of the vanes is labor intensive and, therefore expensive. In addition, gaps can form between the vanes and the wrapper. Coins and other small loose objects can enter these gaps and rattle around, generating undesirable noise. In order to remedy these effects, some prior art wrappers have integrally formed vanes. However, in these prior art wrappers, the integrally formed vanes are not contiguous with the flanges on the end caps. As a result, the integrally formed vanes may vibrate when the spin drum rotates and thereby generate unwanted noise.

As can be appreciated from the foregoing, there is a need in the art for a spin drum that is not conducive to generating unwanted noise, has vanes that are less expensive to install and is composed of less stainless steel. The present invention is directed to such a spin drum.

SUMMARY OF THE INVENTION

It therefore would be desirable, and is an advantage of the present invention, to provide a spin drum that is not conducive to generating unwanted noise, has vanes that are less expensive to install and is composed of less stainless steel. In accordance with the present invention, a spin drum is provided for use in a washing machine. The spin drum includes a generally semi-cylindrical side wall and a first end cap. The side wall has first and second ends and a plurality of vanes extending between the first and second ends. The first and second ends each have a radially corrugated periphery defined in part by the vanes. The first end cap is secured to the first end of the side wall. The first end cap has a flange contoured to fit the first end of the side wall.

It is also desirable and is an object of the present invention to provide a washing machine having a spin drum embodied in accordance with the present invention. The washing machine includes the spin drum, a housing, an outer drum, an electric motor, and a power transmission system. The housing has a panel with an external opening fitted with a door. The outer drum is mounted within the housing. The spin drum is rotatably mounted within the outer drum and includes a generally semi-cylindrical side wall, a first end cap, and a first metal trunnion with a first mounting shaft. The side wall defines a plurality of perforations and further includes first and second ends and a plurality of vanes that extend between the first and second ends. The first and second ends each have a radially corrugated periphery defined in part by the vanes. The first end cap is secured to the first end of the side wall and has a flange that conforms with the radially corrugated periphery of the first end of the side wall. The first metal trunnion is disposed over the first end cap and is secured to the first end of the side wall and to the first end cap. The electric motor has a motor shaft that rotates when the electric motor is provided with electric power. The power transmission system is connected between the first mounting shaft of the first metal trunnion and the motor shaft. The power transmission system is operable to transmit the rotation of the motor shaft to the first mounting shaft so as to rotate the spin drum.

It is also desirable and is an object of the present invention to provide a spin drum for use with a washer wherein the spin drum includes a generally semi-cylindrical side wall, first and second plastic end caps, and first and second metal trunnions. The side wall is composed of stainless steel, has first and second ends and defines a plurality of perforations. The first plastic end cap is secured to the first end of the side wall, while the second plastic end cap is secured to the second end of the side wall. The first metal trunnion is disposed over the first plastic end cap and is secured to the first end of the side wall and to the first plastic end cap. The second metal trunnion is disposed over the second plastic end cap and is secured to the second end of the side wall and to the second plastic end cap.

BRIEF DESCRIPTION OF THE DRAWINGS

The features, aspects, and advantages of the present invention will become better understood with regard to the following description, appended claims, and accompanying drawings where:

DETAILED DESCRIPTION OF THE PREFERRED EMBODIMENTS

Figure 1:
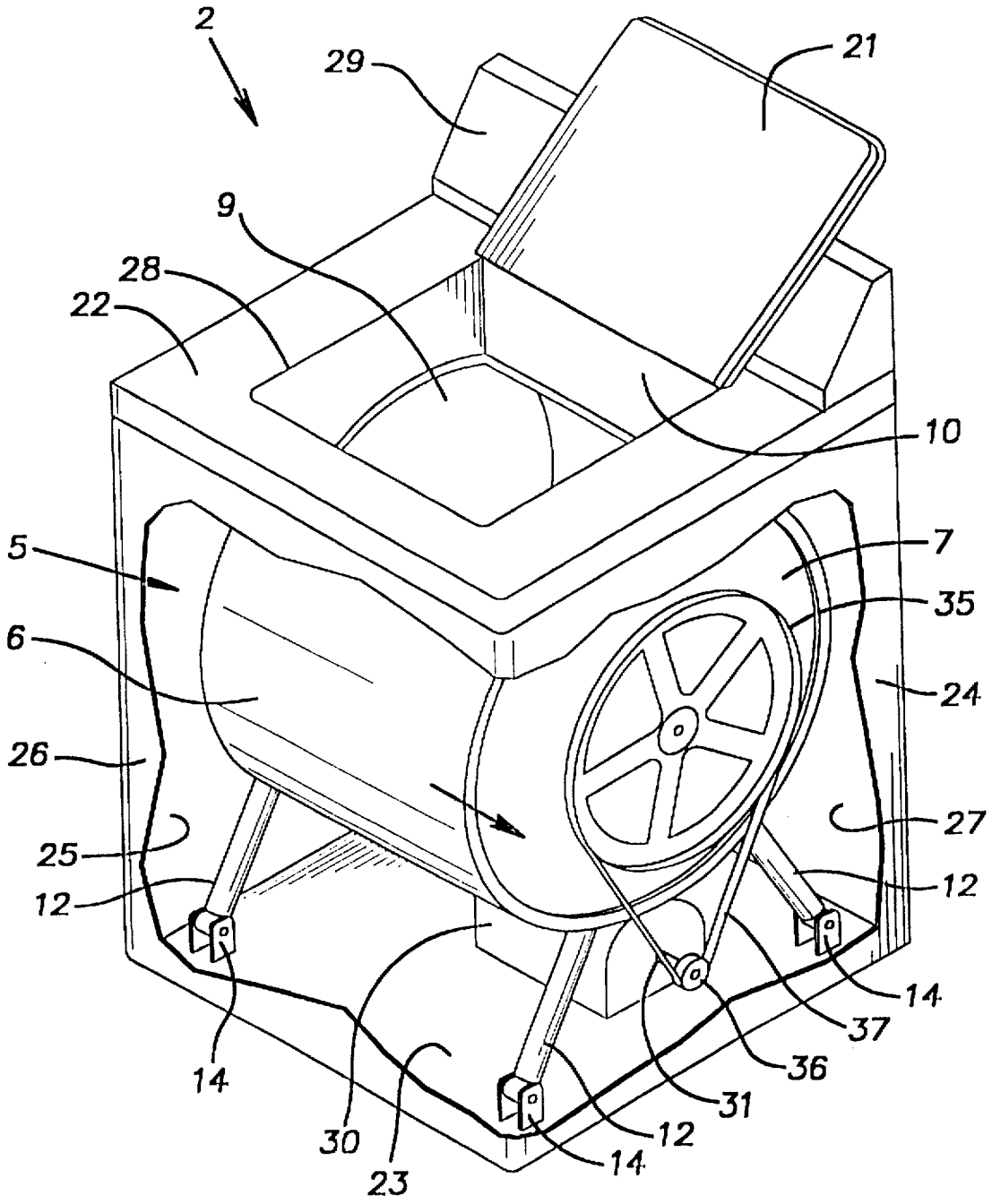
FIG. 1 shows a cut-away interior view of a washer having a spin drum.

It should be noted that in the detailed description which follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Referring now to FIG. 1, there is shown a cut-away interior view of a washer 2, such as a clothes washing machine, having a spin drum 40 (shown in FIGS. 2,3,4) embodied in accordance with the present invention. The washer 2 generally includes the spin drum 40, an outer drum 5, a cabinet or housing, an outer door 21 and an electric motor 30. The housing is substantially rectangular and includes a top panel 22, a bottom panel 23, a front panel 26, a rear panel 27, a first side panel 24, and a second side panel 25, all of which are composed of sheet metal. An exterior opening 28 is centrally disposed in the top panel 22. An angular control panel 29 is mounted to a rear portion of the top panel 22 behind the exterior opening 28. The outer door 21 is pivotally attached to the top panel 22 so as to be movable between a closed position and an open position. In the closed position, the outer door 21 covers the exterior opening 28 and is substantially flush with the top panel 22. In the open position, the outer door 21 uncovers the exterior opening 28 and angles rearward towards the control panel 29.

Figure 2:
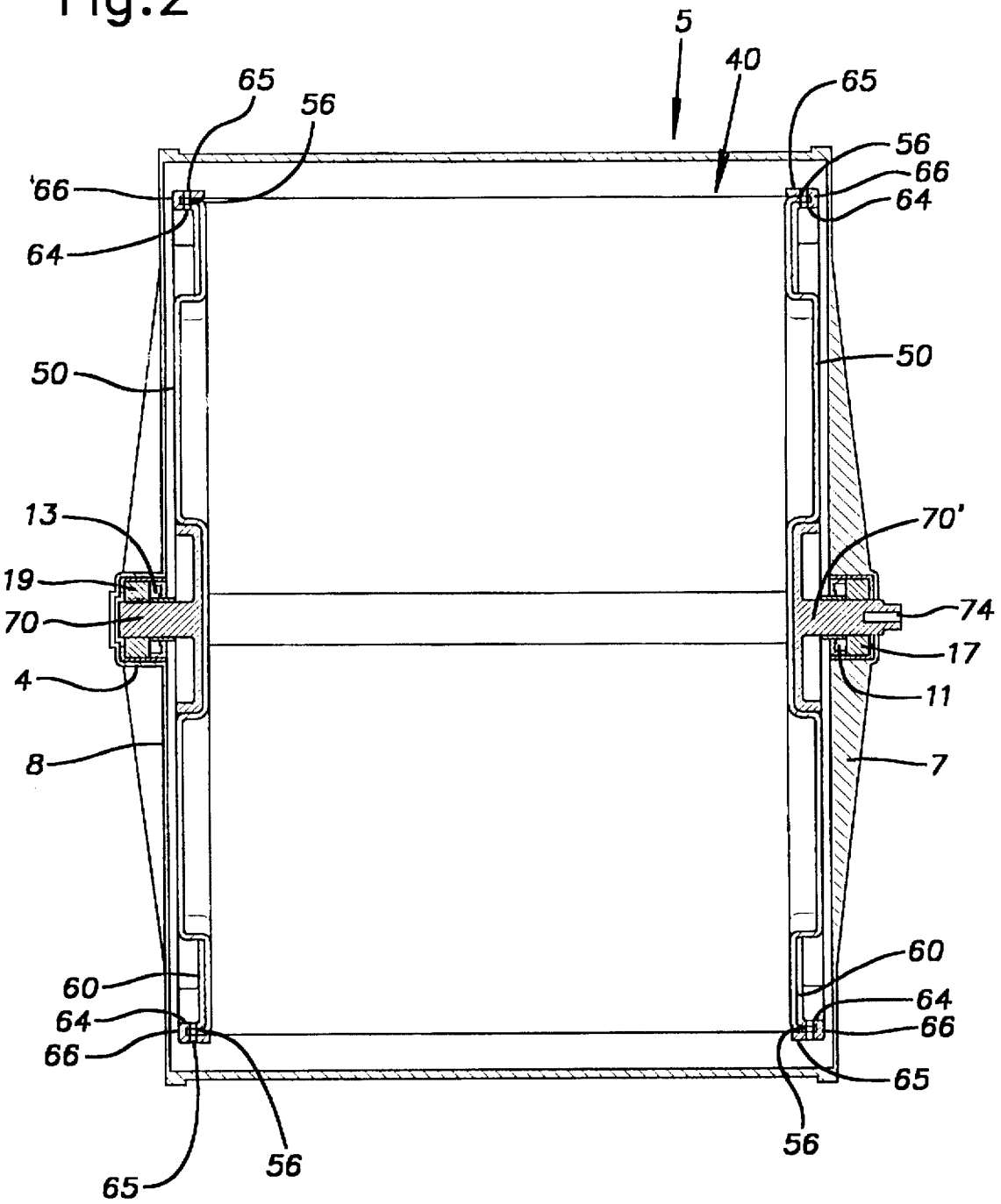
FIG. 2 shows a sectional front view of the spin drum mounted within an outer drum.

The outer drum 5 is cylindrical and has a side wall 6, a first end wall 7, and a second end wall 8 (shown in FIG. 2). The outer drum 5 is situated within the housing such that the first and second end walls 7, 8 are parallel with the first and second side panels 24, 25 of the housing. A rectangular opening 9 is disposed in a top portion of the side wall 6. The rectangular opening 9 is aligned with the exterior opening 28 in the top panel 22 of the housing. A conduit 10 extends between the exterior opening 28 and the rectangular opening 9 so as to provide an access passage between the top panel 22 and the outer drum 5.

The outer drum 5 is disposed within the housing and is supported by a suspension system comprising four shock absorbing legs 12 having top and bottom ends. The bottom ends of the shock absorbing legs 12 are pivotally attached to four bottom brackets 14 that are respectively secured to the bottom panel 23 at its four corners. In a similar manner, the top ends of the shock absorbing legs 12 are pivotally attached to four top brackets (not shown) that are secured to the bottom of the outer drum 5. The bottom ends are attached to the bottom brackets 14 so as to pivot about an axis parallel to the front panel 26, while the top ends are attached to the top brackets so as to pivot about an axis perpendicular to the front panel 26. In this manner, the shock absorbing legs 12 insulate the housing from any movement of the outer drum 5 that may be caused by the rotation of the spin drum 40. Naturally, it is contemplated that numerous equivalent suspension systems may be used with equal functionality.

Referring now to FIG. 2 there is shown a sectional view of the spin drum 40 rotatably mounted within the outer drum 5. As will be described more fully later, the spin drum 40 includes a side wall 44 (shown better in FIGS. 3, 4), a pair of end caps 50, and a pair of spiders or trunnions 60. The side wall 44 is generally semi-cylindrical and has first and second ends 42, 43 that are each fitted with an end cap 50. The trunnions 60 are secured over the end caps 50. The trunnion 60 positioned over the first end 42 has a mounting shaft 70' projecting outward therefrom, while the trunnion 60 positioned over the second end 43 has a mounting shaft 70 projecting outward therefrom. A threaded or tapped bore 74 partially extends through the mounting shaft 70' for mounting of an upper pulley 35 (shown in FIG. 1) to the mounting shaft 70' as will be described more fully hereafter.

As shown in FIG. 2, the spin drum 40 is concentric and coaxial with the outer drum 5. The first end wall 7 of the outer drum 5 has a passage 11 extending therethrough that is fitted with bearings 17. The second end wall 8 of the outer drum 5 has an enclosure 4 with a hollow interior 13 that opens into the interior of the outer drum 5 through an aperture in the second end wall 8. Disposed around the periphery of the hollow interior 13 are a plurality of bearings 19. The mounting shaft 70' is journaled through the passage 11 and projects outward from an exterior surface of the first end wall 7. The mounting shaft 70 extends through the aperture in the second end wall 8 and is rotatably received inside the hollow interior 13 of the enclosure 4. In this manner, the first and second end walls 7, 8 of the outer drum 5 rotatably support the spin drum 40 within the interior of the outer drum 5.

Referring back to FIG. 1, an electric motor 30 is secured to the bottom panel 23 of the washer 2 below the outer drum 5. The electric motor 30 is of a conventional type and is operable to rotate a motor shaft 31 projecting outward therefrom. The rotation of the motor shaft 31 is transmitted to the spin drum 40 by a power transmission system that includes an upper pulley 35, a lower pulley 36 and a drive belt 37. The lower pulley 36 is secured to the motor shaft 31 so as to rotate with the motor shaft 31. The upper pulley 35 is secured to the mounting shaft 70' of the trunnion 60 by a bolt that passes through the upper pulley 35 and is threadably received by the bore 74. The drive belt 37 is tightly wound around the upper pulley 35 and the lower pulley 36. When the motor shaft 31 rotates, the lower pulley 36 generates a rotational force that is transmitted to the upper pulley 35 by the drive belt 37. Since the upper pulley 35 is substantially larger than the lower pulley 36, the upper pulley 35 translates the rotational force into a large torque that is applied to the spin drum 40 through the trunnion 60. As a result of the application of the large torque, the spin drum 40 rotates about a horizontal axis passing through the mounting shafts 70, 70' of the trunnions 60.

It is considered apparent that the present invention is not limited to the foregoing power transmission system. Rather, other drive systems may be employed with equal functionality and without departing from the scope and spirit of the present invention as embodied in the claims appended hereto.

Figure 3:
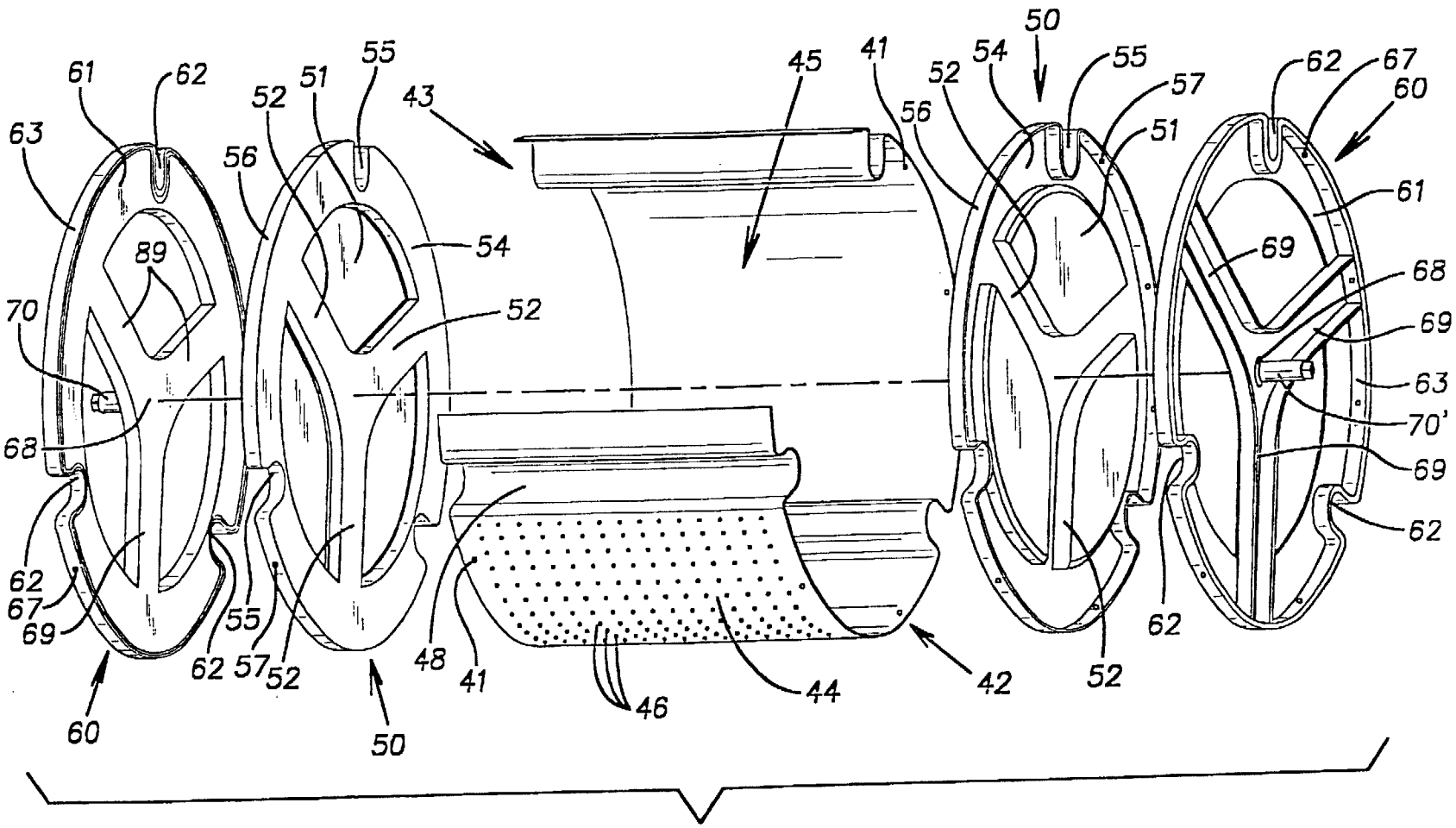
FIG. 3 shows an exploded view of the spin drum.

Referring now to FIG. 3 there is shown an exploded view of the spin drum 40. As shown, the first and second ends 42, 43 of the side wall 44 have radially corrugated peripheries. As used herein, the term "radially corrugated periphery" shall mean generally arcuate with one or more deformed portions that project radially inward or radially outward. Mounting apertures 41 are disposed in the side wall 44 around the radially corrugated peripheries. The side wall 44 is composed of stainless steel and defines an access opening 45. The side wall 44 also has a plurality of openings or perforations 46 formed therein that permit wash fluid to enter and exit the spin drum 40 during the operating cycles of the washer 2. Although not shown, the perforations 46 extend around substantially all of the side wall 44. During the operation of the washer 2, the access opening 45 is covered by an access door (not shown).

Ribs or vanes 48 are integrally formed into the side wall 44 in order to strengthen the side wall 44 so as to prevent its deformation during the operation of the washer 2 and to engage and tumble clothes. The vanes 48 extend along the entire length of the side wall 44 and are preferably disposed equidistantly around the circumference of the side wall 44. The vanes 48 are generally C-shaped in cross-section and project radially inward so as to have interior surfaces raised above interior surfaces of other portions of the side wall 44. The interior surfaces of the vanes 48 are adapted to smoothly engage clothes contained within the spin drum 40. The end portions of the vanes 48 help to form the radially corrugated peripheries of the first and second ends 42, 43 of the side wall 44.

Each of the end caps 50 is composed of molded plastic, are generally circular in shape and have lateral inner and outer surfaces. Each end cap 50 includes a radially outer annular portion 54 disposed around a radially inner circular portion 51. An outer surface of the circular portion 51 is raised above an outer surface of the annular portion 54. Conversely, an inner surface of the annular portion 54 is raised above an inner surface of the circular portion 51.

Three channels 52 extend outward from the center of the circular portion 51 so as to form a substantially Y-shaped recess in the circular portion 51. Each of the channels 52 has a bottom wall with inner and outer surfaces. The inner surface of the bottom wall is coplanar with the inner surface of the annular portion 54, while the outer surface of the bottom wall is generally coplanar with the outer surface of the annular portion 54. Each of the channels 52 also has a pair of opposing side walls that extend between the bottom wall and the outer surface of the circular portion 51. The channels 52 extend outward from each other at equal angles and, thus, divide the circular portion 51 into three equal pie or wedge shaped portions.

The annular portion 54 has a periphery that includes arcuate notches that project radially inward towards the center of the end cap 50. The arcuate notches are evenly spaced around the periphery of the annular portion 54. The arcuate notches are disposed intermediate adjacent channels 52 and are aligned with the peripheral centers of the three pie-shaped portions, as illustrated. A flange 56 projects outward from the periphery of the annular portion 54. The flange 56 extends along the arcuate notches so as to form arcuate flange portions 55. Mounting bores 57 are formed in the flange 56 for alignment with the mounting apertures 41 in the side wall 44.

The peripheries and flanges 56 of the end caps 50 are contoured to fit within the radially corrugated peripheries of the first and second ends 42, 43 of the side wall 44. It should be appreciated, however, that in another embodiment of the present invention to be discussed later, end caps are provided having peripheries and flanges that are contoured to fit over the radially corrugated peripheries of the first and second ends 42, 43 of the side wall 44.

Each of the trunnions 60 is preferably composed of die cast aluminum, and include an outer rim 61 and an inner hub 68 that are integrally connected by three arms 69. The inner hub 68 of the trunnion 60 positioned over the first end 42 of the side wall 44 includes the mounting shaft 70', while the inner hub 68 of the trunnion 60 positioned over the second end 43 of the side wall 44 includes the mounting shaft 70. Each of the arms 69 are channel-shaped and have a planar central member with a pair of opposing flanges extending outwardly therefrom. Each planar central member has an inner surface that is coplanar with an inner surface of the outer rim 61. The outer rim 61 and arms 69 cooperate to define three equal wedge or pie shaped voids or open spaces therebetween. The outer rim 61 has a periphery that includes three rounded notches that project radially inward towards the inner hub 68. The rounded notches are evenly spaced around the periphery of the outer rim 61. The rounded notches are disposed intermediate adjacent arms 69 and are aligned with the peripheral centers of the pie-shaped voids.

A trunnion flange 63 projects outward from the periphery of the outer rim 61. The trunnion flange 63 is U-shaped and has an inner leg 64 (shown in FIG. 2) spaced from an outer leg 65 (shown in FIG. 2) so as to form a groove therebetween. The inner leg 64 projects outward from the periphery of the outer rim 61 and is connected by a bight 66 (shown in FIG. 2) to the outer leg 65, which projects inward towards the outer rim 61. As such, the groove defined by the trunnion flange 63 is inwardly opening. The inner and outer legs 64, 65 each have a series of mounting holes 67 formed therein, which align with the mounting bores 57 in the end cap 50 and the mounting apertures 41 in the side wall 44. The trunnion flange 63 extends along the rounded notches in the periphery of the outer rim 61 so as to form arcuate or bent U-shaped portions 62.

With regard to the trunnion 60 positioned over the first end 42 of the side wall 44, the periphery of the outer rim 61 and the trunnion flange 63 are contoured so as to have the trunnion flange 63 bracket both the first end 42 of the side wall 44 and the flange 56 on the end cap 50 when the trunnion 60 is secured over the end cap 50 and the first end 42. With regard to the trunnion 60 positioned over the second end 43 of the side wall 44, the periphery of the outer rim 61 and the trunnion flange 63 are contoured so as to have the trunnion flange 63 bracket both the second end 43 of the side wall 44 and the flange 56 on the end cap 50 when the trunnion 60 is secured over the end cap 50 and the second end 43.

Figure 4:
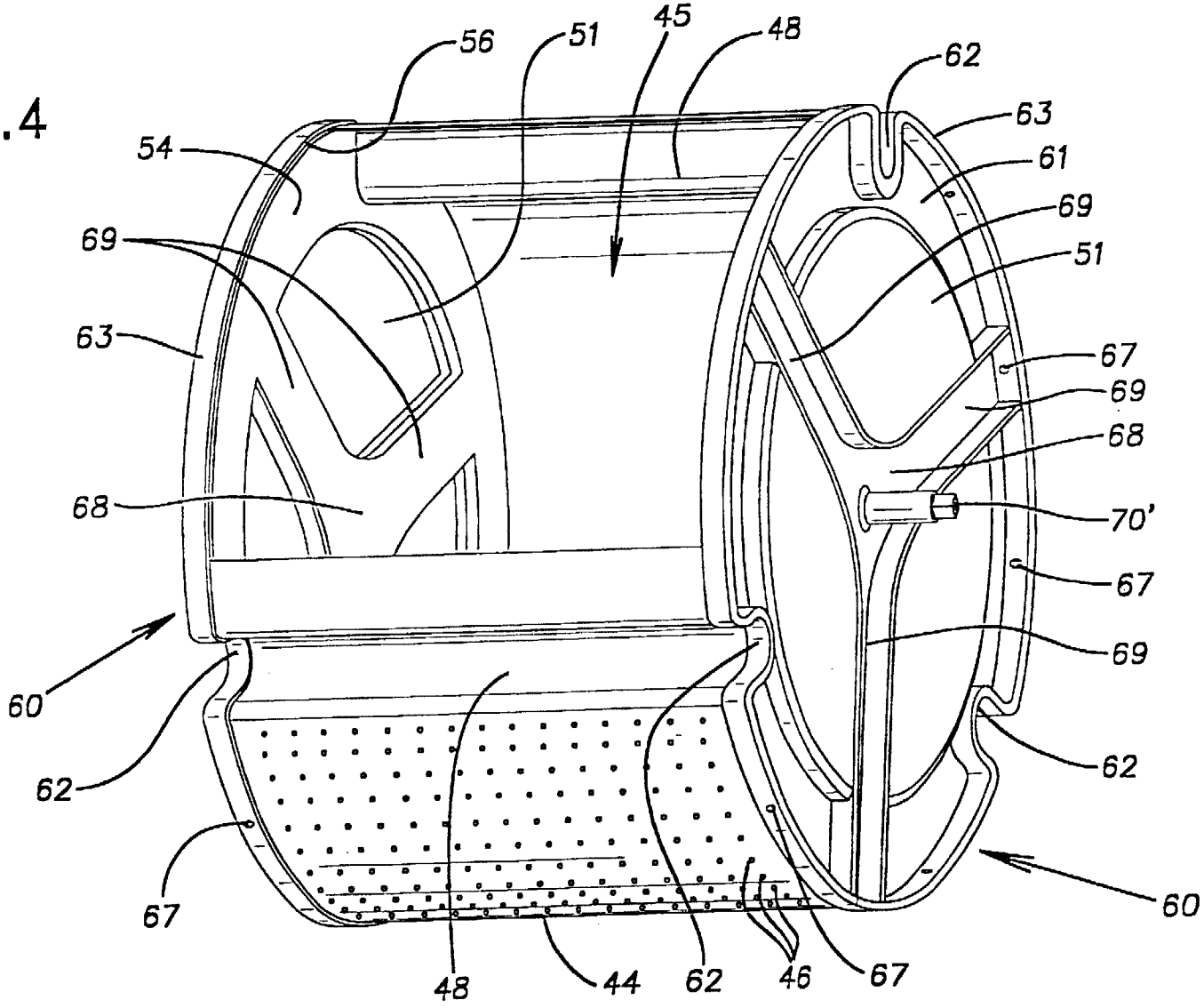
FIG. 4 shows an assembled view of the spin drum.

Referring now to FIG. 4 there is shown an assembled view of the spin drum 40. The end caps 50 are respectively positioned within the first and second ends 42, 43 of the side wall 44 such that the flanges 56 on the end caps 50 are contiguous with the radially corrugated peripheries of the first and second ends 42, 43. With the end caps 50 so positioned, the arcuate flange portions 55 surround, and are contiguous with, the interior surfaces of the end portions of the vanes 48. The trunnions 60 are positioned over the end caps 50. The arms 69 of the trunnions 60 are disposed within the channels 52 in the circular portions 51 of the end caps 50. The central members of the arms 69 rest against the bottom walls of the channels 52 and the opposing flanges of the arms 69 abut the opposing walls of the channels 52. The bent U-shaped portions 62 of the trunnions 60 bracket the arcuate flange portions 55 of the end caps 50 as well as the end portions of the vanes 48.

With regard to the trunnion 60 positioned over the end cap 50 on the first end 42 of the side wall 44, the trunnion flange 63 covers both the corrugated periphery of the first end 42 as well as the flange 56 on the end cap 50. More specifically, and as shown best in FIG. 2, the inner leg 64 is radially inward and adjacent to the flange 56 on the end cap 50 and the outer leg is radially outward and adjacent to the first end 42 of the side wall 44. With regard to the trunnion 60 positioned over the end cap 50 on the second end 43 of the side wall 44, the trunnion flange 63 covers both the corrugated periphery of the second end 43 as well as the flange 56 on the end cap 50. More specifically, and as shown best in FIG. 2, the inner leg 64 is radially inward and adjacent to the flange 56 on the end cap 50 and the outer leg is radially outward and adjacent to the second end 43 of the side wall 44.

With the end caps 50 and the trunnions 60 positioned in the foregoing manner, the mounting apertures 41 in the side wall 44 are aligned with the mounting bores 57 in the end caps 50 and the mounting holes 67 in the trunnions 60, thereby forming a plurality of mounting passages. Dowel pins are inserted through the mounting passages to firmly secure the end caps 50 and the trunnions 60 to the side wall 44. In lieu of the dowel pins, screws, snap fits, or nuts and bolts can be used to secure the spin drum 40 together.

It should be appreciated that the foregoing construction of the spin drum 40 provides numerous benefits. The plastic composition of the end caps 50 reduces the amount of stainless steel used in the spin drum 40 and thereby reduces the manufacturing cost of the spin drum 40. The integration of the vanes 48 with the side wall 44 further reduces the manufacturing cost of the spin drum 40 since separate vanes do not have to be manually secured to the side wall 44. The contoured shapes of the end caps 50 and the trunnions 60 enable the vanes 48 to be securely fastened to the end caps 50 and the trunnions 60 so as to prevent the vanes 48 from vibrating. In addition to supporting the spin drum 40 and securing the vanes 48, the trunnions 60 transmit torsional forces to and from the spin drum 40 through their arms 69 and trunnion flanges 63. The torsional forces transmitted by the trunnions 60 are distributed over large portions of the end caps 50 by the channels 52 in the circular surfaces 51 of the end caps 50. This distribution of torsional forces helps minimize possible deflections of the end caps 50 and helps prevent material fatigue. As a result, a material such as plastic can be used in the construction of the end caps 50. Another function of the trunnions 60 is to serve as counterweights for the access door (not shown) that covers the access opening 45 so as to help balance the spin drum 40 during the operation of the washer 2.

Although the preferred embodiment of this invention has been shown and described, it should be understood that various modifications and rearrangements of the parts may be resorted to without departing from the scope of the invention as disclosed and claimed herein. For example, struts can be secured within the vanes 48 of the side wall 44 to provide extra support for the spin drum 40. In addition, the trunnions 60 can be composed of another type of metal such as stainless steel. In another embodiment of the present invention, a spin drum can be provided wherein the spin drum includes the side wall 44 and has altered end caps and altered trunnions. The altered end caps are slightly enlarged and have level surfaces without channels. Flanges project inward instead of outward from the altered end caps so that the altered end caps fit over, instead of inside, the first and second ends 42, 43 of the side wall 44. The altered trunnions are also slightly enlarged and have plate-shaped flanges instead of U-shaped flanges. The altered trunnions fit over the altered end caps such that the plate-shaped flanges simply fit over, instead of bracketing, the flanges on the altered end caps and the radially corrugated peripheries of the first and second ends 42, 43 of the side wall 44. Mounting passages fitted with dowel pins are provided to secure the spin drum together.

What is claimed is:

1. A spin drum for use in a washing machine, said spin drum comprising:

a generally semi-cylindrical side wall having first and second ends and a plurality of vanes extending between the first and second ends, said first and second ends each having a periphery defined in part by the vanes;

a first end cap secured to the first end of the side wall, said first end cap having a flange contoured to fit the first end of the side wall; and a first trunnion disposed over the first end cap, said first trunnion having a flange that brackets the first end of the side wall and the flange on the first end cap.

2. The spin drum of claim 1 wherein the side wall is composed of stainless steel.

3. The spin drum of claim 1 wherein the vanes are integral with the side wall and project radially inward toward a center of the side wall.

4. The spin drum of claim 1 wherein the first trunnion is secured to the first end of the side wall and to the first end cap.

5. The spin drum of claim 4 further comprising:

a second end cap secured to the second end of the side wall, said second end cap having a flange contoured to fit the second end of the side wall, and a second trunnion disposed over the second end cap and being secured to the second end of the side wall and to the second end cap.

6. The spin drum of claim 5 wherein the side wall defines an access opening for loading items into the spin drum and a plurality of perforations for permitting fluid to pass through the spin drum.

7. The spin drum of claim 5 wherein the first and second end caps are composed of plastic.

8. The spin drum of claim 5 wherein the first and second trunnions are composed of a metal.

9. The spin drum of claim 8 wherein the metal is aluminum.

10. The spin drum of claim 5 wherein the flanges of the first and second end caps respectively fit inside the first and second ends of the side wall so as to be contiguous therewith.

11. The spin drum of claim 10 wherein the first trunnion comprises a central hub, a plurality of arms and an outer rim, said arms radially extending from the central hub to the outer rim and said outer rim having the flange that brackets the periphery of the first end of the side wall and the flange on the first end cap; and wherein the second trunnion comprises a central hub, a plurality of arms and an outer rim, said arms radially extending from the central hub to the outer rim and said outer rim having a flange that brackets the second end of the side wall and the flange on the second end cap.

12. The spin drum of claim 11 wherein the first end cap further comprises an annular portion disposed around a circular portion, said annular portion having a periphery from which the flange projects and said circular portion having channels for receiving the arms of the first trunnion; and wherein the second end cap further comprises an annular portion disposed around a circular portion, said annular portion having a periphery from which the flange projects and said circular portion having channels for receiving the arms of the second trunnion.

13. A washing machine comprising:

a housing having a panel with an external opening fitted with a door;

an outer drum mounted within the housing;

a spin drum rotatably mounted within the outer drum, said spin drum comprising:

a generally semi-cylindrical side wall defining a plurality of perforations, said side wall having first and second ends and a plurality of vanes extending between the first and second ends, said first and second ends each having a periphery defined in part by the vanes;

a first end cap secured to the first end of the side wall, said first end cap having a flange that conforms with the periphery of the first end of the side wall;

a first metal trunnion having a first mounting shaft and a first flange, said first flange conforming to the periphery of the first end of the side wall, said first metal trunnion being disposed over the first end cap and being secured to the first end of the side wall and to the first end cap;

an electric motor having a motor shaft that rotates when the electric motor is provided with electric power; and a power transmission system connected between the first mounting shaft of the first metal trunnion and the motor shaft, said power transmission system being operable to transmit the rotation of the motor shaft to the first mounting shaft so as to rotate the spin drum.

14. The washing machine of claim 13 wherein the spin drum is rotatable around a horizontal axis and wherein the outer drum comprises a generally cylindrical surface and first and second end walls, said first end wall defining a passage through which the first mounting shaft of the first metal trunnion is journaled.

15. The washing machine of claim 14 wherein the spin drum further comprises:

a second end cap secured to the second end of the side wall, said second end cap having a flange that conforms with the periphery of the second end of the side wall; and a second metal trunnion having a second mounting shaft and a second flange, said second flange conforming to the periphery of the second end of the side wall, said second metal trunnion being disposed over the second end cap and being secured to the second end of the side wall and to the second end cap.

16. The washing machine of claim 15 wherein the second end wall of the outer drum is adapted to rotatably support the second mounting shaft of the second metal trunnion and wherein the cylindrical surface of the outer drum has an opening aligned with the external opening in the panel of the housing.

17. The washing machine of claim 16 wherein the side wall of the spin drum defines an access opening through which items are loaded into the spin drum.

18. A spin drum for use with a washer, said spin drum comprising:

a generally semi-cylindrical side wall having first and second ends, said side wall being composed of stainless steel and defining a plurality of perforations;

a first plastic end cap secured to the first end of the side wall;

a second plastic end cap secured to the second end of the side wall;

a first metal trunnion disposed over the first plastic end cap and secured to the first end of the side wall and to the first plastic end cap; and a second metal trunnion disposed over the second plastic end cap and secured to the second end of the side wall and to the second plastic end cap.

19. The spin drum of claim 18 wherein the first and second ends of the side wall have radially corrugated peripheries and wherein the side wall further comprises a plurality of vanes extending between the first and second ends, said vanes helping to define the radially corrugated peripheries of the first and second ends.

20. The spin drum of claim 19 wherein the first and second plastic end caps respectively have flanges that are respectively contoured to fit the radially corrugated peripheries of the first and second ends of the side wall.

21. The spin drum of claim 20 wherein the first and second metal trunnions respectively have U-shaped flanges that are respectively contoured to bracket the radially corrugated peripheries of the first and second ends of the side wall and the flanges on the first and second plastic end caps.

* * * * *